US005313886A

United States Patent [19]

Müller

[11] Patent Number: 5,313,886

[45] Date of Patent: May 24, 1994

[54] ELECTRONIC METHOD OF POSITIONING A REGISTER MARK SENSOR OF A SHEET PRINTING MACHINE

[75] Inventor: Tobias Müller, Hirschberg, Fed. Rep. of Germany

[73] Assignee: Heidelberger Druckmaschinen AG, Heidelberg, Fed. Rep. of Germany

[21] Appl. No.: 73,104

[22] Filed: Jun. 7, 1993

[30] Foreign Application Priority Data

Jun. 6, 1992 [DE] Fed. Rep. of Germany ..... 4218764

[51] Int. Cl.[5] ..... B41F 13/24

[52] U.S. Cl. ..... 101/486; 101/248; 250/571; 250/548

[58] Field of Search ..... 101/485, 486, 247, 248, 101/219, 228, 181; 250/548, 561, 208.1, 571; 226/3, 16, 27, 31

[56] References Cited

U.S. PATENT DOCUMENTS

| | | | |
|---|---|---|---|
| 3,653,322 | 4/1972 | Richardson | 101/248 |
| 3,701,464 | 10/1972 | Crum | 101/181 |
| 4,025,025 | 5/1977 | Bartel et al. . | |
| 4,363,271 | 12/1982 | Horst | 250/548 |
| 4,437,403 | 3/1984 | Griener | 101/248 |
| 4,484,522 | 11/1984 | Simeth . | |
| 4,495,583 | 1/1985 | Punater | 226/3 |
| 4,887,530 | 12/1989 | Sainio | 101/486 |
| 4,994,975 | 2/1991 | Minschart | 101/248 |
| 5,224,640 | 7/1993 | Fokos et al. | 101/27 |

FOREIGN PATENT DOCUMENTS

| | | |
|---|---|---|
| 0186620 | 7/1986 | European Pat. Off. . |
| 3136703 | 11/1982 | Fed. Rep. of Germany . |
| 3811359 | 10/1989 | Fed. Rep. of Germany . |
| 4106082 | 10/1991 | Fed. Rep. of Germany . |
| 59-48160 | 3/1984 | Japan . |
| 62-124959 | 6/1987 | Japan . |
| 381713 | 9/1964 | Switzerland . |
| 2218046 | 11/1989 | United Kingdom . |

*Primary Examiner*—Eugene H. Eickholt
*Attorney, Agent, or Firm*—Herbert L. Lerner; Laurence A. Greenberg

[57] ABSTRACT

A method for positioning a register mark sensor in a sheet printing machine, wherein a register mark sensor is moved in direction perpendicular to the direction of the movement of the sheet for detecting a register mark arrangement on the sheet, wherein the register mark sensor is moved until it is positioned in a defined scanning position relative to the register mark arrangement, the method of which includes the steps of: placing on the sheet a preliminary register mark, a given known distance A, perpendicular to the direction of the movement of the sheet, from a given register mark line, and after printing at least one sheet, positioning the preliminary mark sensor in relation to the preliminary mark.

4 Claims, 2 Drawing Sheets

ELECTRONIC METHOD OF POSITIONING A REGISTER MARK SENSOR OF A SHEET PRINTING MACHINE

The invention relates to a method for positioning a register mark sensor of a sheet printing machine.

The invention is applicable to an on-line register adjustment arrangement for which one or several scanning devices are provided for scanning register mark lines positioned at right and oblique angles to the direction of the sheet movement.

A remote-controlled register adjusting device for a printing machine is described in German Patent Application DE 31 36 701 C1, wherein two scanning devices are mounted on a cross bar positioned at right angles to the direction of the paper flow. The scanning devices are directed to pass marks on a printing plate mounted on a plate cylinder. The pass marks are in one version formed as pass crosses, wherein at least one leg of the cross stretches across a certain range of the periphery of the plate cylinder.

According to this approach, the scanning systems are moved along the cross bar until sensors detect the pass marks and generate pulses to an evaluation device. By that means, the printing plate is adjusted in circumferential and in diagonal direction by the register adjusting devices, and in the evaluation device a new position value is computed, according to which the scanning device is again positioned.

A drawback to this system is that the register adjustment depends on the accuracy of the positioning of the scanning systems, which in turn requires extremely precise and expensive positioning and scanning systems. Furthermore, all additional printing units of the printing machine require also scanning systems which are similarly directed to the printing plates of the respective plate cylinders. Further still, these devices are only constructed for coarse positioning of the register on the mounting of the plate cylinder, which does not provide the necessary accuracy required for continued printing.

In a lay-out publication DE 41 06 082 A1, a proposed method and device for positioning of a measuring field by means of a sensor device is provided, which directs a light spot to a selected area of the surface of a cylinder in a rotary printing machine. The light spot is generated by a pilot light source. The position of the light spot is stored in a computing and control device and the sensor device is adjusted such that the measured position values of the selected area are determined. In this manner, a register mark sensor can be positioned on a register mark line along a cross bar such that the light spot is directed to the middle of the register mark line.

This approach has the drawback that the register mark sensor must be directed visually by a human operator. and the accuracy of the positioning is therefore subjective and depends on the operator.

In a lay-out publication DE 38 11 359, an arrangement for determining register mark deviations is disclosed, whereby a measuring head is adjusted to a position wherein the register mark is located. The measuring head is moved along a cross bar to a preset position within the range of an ink zone, wherein the preset position is entered in an input device as a nominal position value for the positioning device. Within the ink zone range, the measuring head is automatically finely positioned precisely in the required scanning position.

A drawback of this method is that the measuring head is moved in step-by-step manner to the scanning position, while a number of sheets are being printed, which give rise to wasted sheets. This method is therefore uneconomical and wasteful of time.

It is therefore the object of the invention to provide a method for positioning a register mark sensor, which is not complicated and provides fast positioning of the sensor.

The invention provides the feature that during the movement of a sheet through the printing machine, a preliminary mark is generated on the sheet, wherein the preliminary mark is positioned in direction perpendicular to the direction of the movement of the sheet a fixed distance A from a register mark line, and that the register mark sensor is positioned in relation to the preliminary mark after printing of at least one sheet.

In regard to the complexity of the device, it is advantageous that the preliminary mark is positioned in alignment with and either before or after the register mark arrangement ($A=0$). In this version of the invention, it is possible to detect the preliminary mark and the register arrangement with the very same register mark sensor, and therefore no additional preliminary mark sensor is required.

A fast positioning of the register marks sensor can be attained by, during the positioning of the register mark sensors, stopping the printing machine, or if several register mark sensors simultaneously sense the preliminary mark, within a defined machine angle of rotation or within a defined range of angle of rotation slowing down the motion of the machine to a quite slow speed. The preliminary mark is then scanned by the register mark sensor, or by an additional preliminary mark sensor, wherein the scanning point of the preliminary mark sensor and the register mark sensor is positioned on the printed material on a line perpendicularly to the direction of the movement of the sheet, and wherein the preliminary mark sensor and the register mark sensor are moving simultaneously.

Another version of the invention is arranged such that the preliminary mark is positioned in direction of the sheet movement as a full width line within a defined machine angle range proximal on the register mark line. In that manner, it is possible to position the register mark sensor and, respectively, the preliminary mark sensor within a large machine angle of rotation and therefore during a larger time interval, which helps to improve the speed and precision of the positioning. The preliminary register mark can be printed in full line width within the width of the register marks or as two or more thin lines oriented in direction of the sheet movement.

In accordance with the invention, there is provided a method for positioning a register mark sensor in a sheet printing machine, wherein a register mark sensor is moved in direction perpendicular to the direction of the movement of the sheet for detecting a register mark arrangement defining a register mark line on the sheet, wherein the register mark sensor is moved until it is positioned in a defined scanning position relative to the register mark arrangement, the method which comprises the steps of:

(a) placing on the sheet a preliminary register mark, a given known distance A, in direction perpendicular to the direction of the movement of the sheet, the given register mark line, and (b) after printing at least one sheet, positioning the register mark sensor in relation to the preliminary mark.

In accordance with a further feature, the invention includes the step of:

placing the preliminary mark in direction of the sheet movement, in line before or behind the register mark arrangement, and along the register mark line.

In accordance with still another feature, the invention includes the step of:

placing the preliminary mark in direction of the sheet movement as a full-width line along a defined machine rotation angle range, proximal to the register mark arrangement.

In accordance with a concomitant feature, the invention includes the steps of:

stopping and slowing down, during positioning of the register mark sensors, the speed of the printing machine within a given rotational angle in relation to the preliminary mark, wherein the rotational angle is defined so that at least one of the register mark sensor and/or an additional preliminary mark sensor is within a respective sensing range of the register mark sensor and/or the additional preliminary mark sensor, moving the preliminary register mark sensor together with the register mark sensor in direction perpendicular to the sheet movement, and determining the defined scanning position such that the distance A in direction perpendicular to the sheet movement from the preliminary mark to the register mark on the printing material is equal to distance A.

Other features which are considered as characteristic for the invention are set forth in the appended claims.

Although the invention is illustrated and described herein as embodied in a method for positioning a register mark sensor of a sheet printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
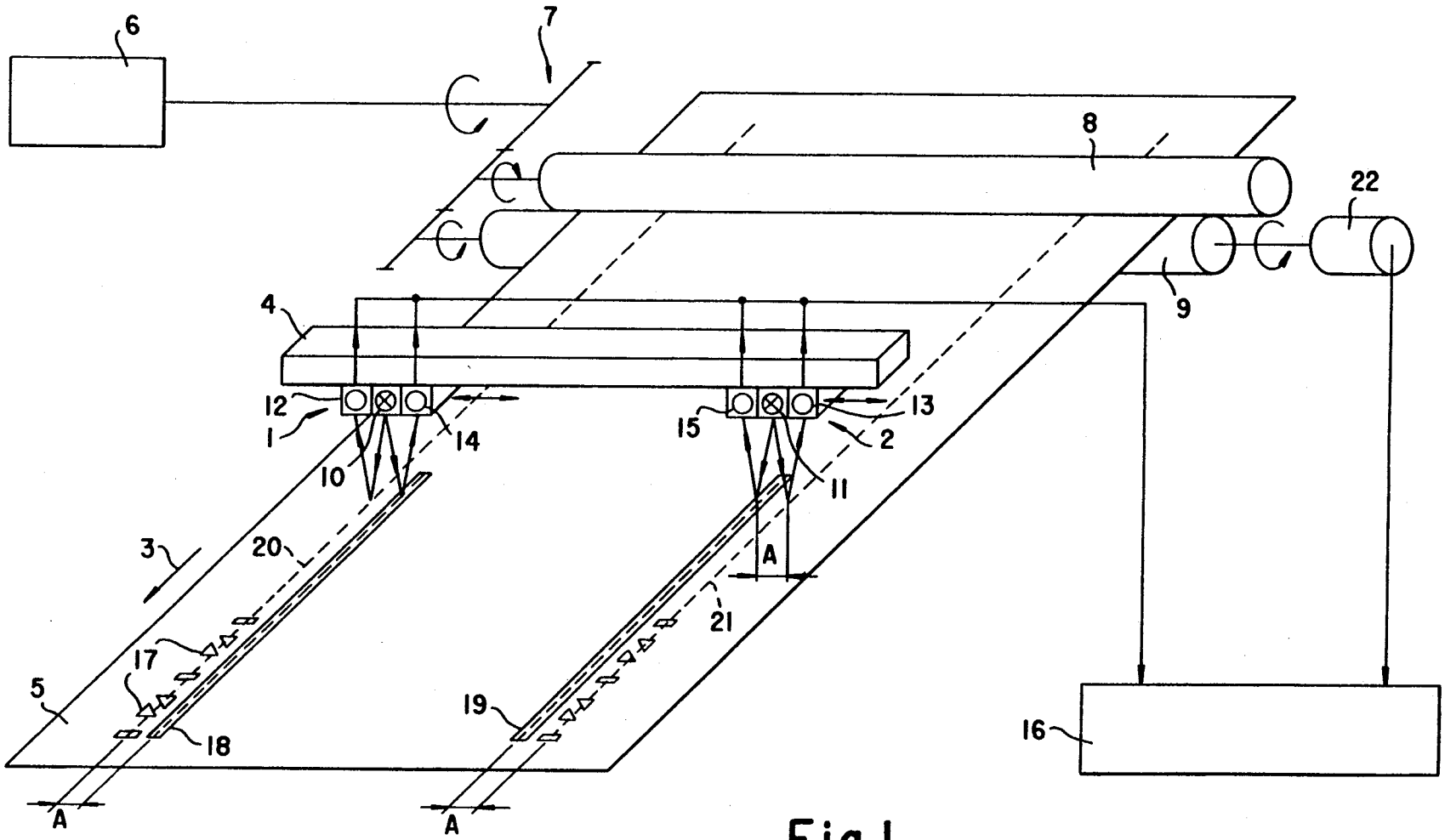
FIG. 1 shows a positioning device according to the invention.

FIG. 1 shows diagrammatically a positioning device, with which the disclosed method can be performed. The positioning device includes two scanning devices 1, 2, which are movable in direction perpendicular to direction 3 of the sheet 5 along a cross bar 4. A sheet 5 is driven by a drive 6, connected to a gear wheel transmission 7 and by means of transporting cylinders 8 and 9 below and past the scanning devices 1, 2. The scanning devices 1, 2 each have a light source 10, 11, a register mark sensor 12, 13 and a preliminary mark sensor 14, 15. The register mark sensors 12, 13 and the preliminary mark sensors 14, 15 are connected with a machine control 16, which controls the printing machine and other elements such as register adjusting devices of the printing machine (not shown).

In order to practice the method of the invention, in a first step register marks 17 , and for each scanning device 1, 2, a preliminary mark 18, 19 is printed on the sheet 5. In a further step, the register mark sensors 12, 13 are brought into scanning position by moving them in direction perpendicular to the direction 3 of the sheet 5, until the preliminary mark sensors 14, 15 have detected the preliminary marks 18, 19, and are precisely positioned in a defined scanning position, for example at an edge or at the middle of the preliminary marks 18, 19.

Since the scanning points of the register mark sensors 12, 13 and the preliminary mark sensors 14, 15 are separated by the same distance A as the distance between the centerline of the register lines 20, 21 and the edge or the center line of the respective preliminary marks 18, 19, it is certain that with the positioning of the preliminary sensors 14, 15 in relation to the preliminary marks 18, 19, the register mark sensors 12, 13 are also positioned exactly in their scanning positions.

In order to evaluate the signals from the preliminary mark sensors 14, 15 in the machine control 16, these signals are processed together with signals from an incremental angle transmitter 22 coupled to the cylinder 9, whereby the position of the preliminary marks 18, 19 is established in direction 3 of the sheet 5, due to the fact that the sheet, when transported through the printing machine without any slip, is positioned exactly in a defined position, as determined by a certain rotary angle of the machine.

Figure 2:
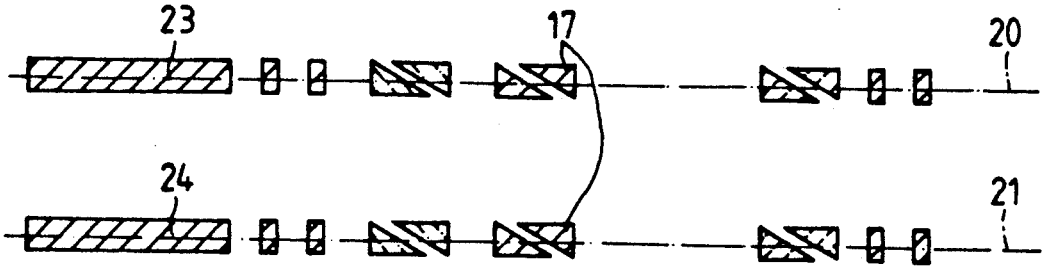
FIG. 2 shows a preliminary mark and a register mark arrangement within the lines of a register mark.

FIG. 2 shows an arrangement of preliminary marks 23, 24, which are located on the register mark lines 20, 21, and are in line with the register marks 17. With such an arrangement, a preliminary mark sensor 14, 15 is not required. Its function is performed by the respective register mark sensor 12, 13, wherein, during positioning of the register mark sensors 12, 13 in relation to the preliminary marks 23, 24, the above described arrangement coordinates the signals from the angle generator 22 with the signals from the register mark sensors 12, 13, which among other functions can also operate as preliminary mark sensors.

Since the positioning of the register mark sensors 12, 13 require a given length of time, it is advantageous, in order to avoid waste of paper, to either stop the machine at a certain machine angle, or to operate the machine slowly within an angular range which includes the preliminary marks 18, 19 or 23, 24.

I claim:

1. A method for positioning a register mark sensor in a sheet printing machine, wherein a register mark sensor is moved in direction perpendicular to the direction of the movement of the sheet for detecting a register mark arrangement on the sheet, wherein the register mark sensor is moved until it is positioned in a defined scanning position relative to the register mark arrangement, the method of which comprises the steps of:

(a) placing on the sheet a preliminary register mark, a given known distance A, perpendicular to the direction of the movement of the sheet, from a given register mark line, and (b) after printing at least one sheet, positioning the preliminary mark sensor in relation to the preliminary mark.

2. A method according to Claim 1, further comprising the step of:

placing the preliminary mark in direction of the sheet movement, in line before or behind the register mark arrangement, and within the register mark line.

3. A method according to claim 1, further comprising the step of:

placing the preliminary mark in direction of the sheet movement as full-width line along a defined machine angular rotation angle range proximal to the register mark arrangement.

4. A method according to claim 1, further comprising the steps of:

stopping or slowing down during Positioning the speed of the printing machine at a given rotational angle in relation to the preliminary mark, said rotational angle defined so that the register mark sensor or an additional preliminary mark sensor is within a respective sensing range of the register mark sensor or the additional preliminary mark sensor, moving the preliminary register mark sensor together with the register mark sensor in direction perpendicular to the sheet movement, and determining the defined scanning Position such that the distance in direction perpendicular to the sheet movement from the preliminary mark sensor to the register mark sensor on the printing material is equal to distance A.

* * * * *